US005918783A

United States Patent [19]

Kieras et al.

[11] Patent Number: 5,918,783

[45] Date of Patent: Jul. 6, 1999

[54] THERMOPLASTIC SQUEEZE TUBE WITH SELF-SEALING DISPENSING ORIFICE

[75] Inventors: Ronald E. Kieras, Woodstock; Fred M. Ekstrom, Algonquin, both of Ill.

[73] Assignee: Courtaulds Packaging, Inc., Woodstock, Ill.

[21] Appl. No.: 08/882,963

[22] Filed: Jun. 26, 1997

[51] Int. Cl.[6] ..... B65D 47/10; B65D 35/08

[52] U.S. Cl. ..... 222/541.6; 222/541.5; 222/541.9; 222/545; 222/107

[58] Field of Search ..... 222/107, 494, 222/545, 530, 541.5, 541.6, 541.9, 47

[56] References Cited

U.S. PATENT DOCUMENTS

| | | | |
|---|---|---|---|
| 1,738,080 | 12/1929 | Smith . | |
| 1,739,871 | 12/1929 | Smith . | |
| 1,739,922 | 12/1929 | Smith . | |
| 1,825,553 | 9/1931 | Smith . | |
| 2,517,027 | 8/1950 | Rado | 222/94 |
| 2,550,132 | 4/1951 | Woods | 222/490 |
| 2,552,715 | 5/1951 | Gray et al. | 222/490 |
| 2,670,884 | 3/1954 | Swartz | 222/490 |
| 3,063,601 | 11/1962 | Hertz | 222/213 |
| 3,072,304 | 1/1963 | Junaid | 222/493 |
| 3,204,835 | 9/1965 | Michel | 222/541.5 |
| 3,610,477 | 10/1971 | Herzig | 222/213 |
| 3,669,323 | 6/1972 | Harker et al. | 222/490 |
| 3,773,233 | 11/1973 | Souza | 222/490 |
| 4,109,836 | 8/1978 | Falarde | 222/494 |
| 4,747,501 | 5/1988 | Greaves | 222/541.5 |
| 4,821,897 | 4/1989 | Weiler | 222/541.6 |
| 4,917,267 | 4/1990 | Laverdure | 222/541.5 |
| 5,012,956 | 5/1991 | Stoody | 222/94 |
| 5,076,474 | 12/1991 | Hansen | 222/541.5 |
| 5,226,568 | 7/1993 | Newton et al. | 222/212 |
| 5,228,593 | 7/1993 | O'Meara | 222/541.5 |
| 5,398,853 | 3/1995 | Latham | 222/491 |

*Primary Examiner*—Andres Kashnikow
*Assistant Examiner*—Keats Quinalty
*Attorney, Agent, or Firm*—Armstrong, Westerman Hattori, McLeland & Naughton

[57] ABSTRACT

A thermoplastic squeeze tube has a self-sealing orifice where a one-way valve member is secured in the tube neck and an exposed portion thereof enclosed and protected by a frangible closure member integral with the neck portion. A pocket in the bottom wall of the frangible closure member closely encloses the one-way valve member to seal the same. A replacement cup-shaped closure member may be provided to reseal the tube after removal of the frangible closure member, which may have downwardly depending sealing protrusions which contain the upper portion of the exposed section of the one-way valve member to reseal the same.

16 Claims, 2 Drawing Sheets

THERMOPLASTIC SQUEEZE TUBE WITH SELF-SEALING DISPENSING ORIFICE

FIELD OF THE INVENTION

The present invention relates to a thermoplastic squeeze tube which contains a one-way valve for use in discharging the contents of the tube and more specifically to such a thermoplastic squeeze tube that has an initial seal of the one-way valve and a replaceable cap for use in sealing the one-way valve after the initial seal is broken.

BACKGROUND OF THE INVENTION

Thermoplastic squeeze tubes are used in the packaging of numerous consumer products such as toothpaste, shampoo, foodstuffs, cosmetics, and the like. Such thermoplastic squeeze tubes may be produced from thermoplastic cylindrical tubular bodies on which a neck portion and head portion or formed with a dispensing orifice formed through the neck. After placing a cap on the neck and filling the tube with the desired contents, the other end of the tube is sealed to protect the contents from the atmosphere. In use, the cap is removed from the tube neck and the tube wall squeezed to discharge tube contents through the dispensing orifice. The cap is then replaced after use to protect the tube contents.

In some instances, it would be beneficial to provide a one-way valve in the dispensing orifice of the tube, such as when the tubes are used to display various products, such as cosmetics, in a retail store so that the user need not remove and replace a cap on the tube neck for each incremented dispersement of the tube contents. The use of one-way valves in combination with a squeeze tube has previously been suggested but such previous combinations have not been as useful as is desirable.

It is an object of the present invention to provide a thermoplastic squeeze tube having a one-way dispensing valve which has an integral frangible closure member to protect the valve from inadvertent discharge during shipping and storage.

It is another object of the present invention to provide a thermoplastic squeeze tube having a one-way dispensing valve which has an integral frangible closure member to protect the valve from inadvertent discharge during shipping and storage, in combination with a replacement closure member to protect the valve after the frangible closure member has been removed from the body of the squeeze tube.

It is a further object of the present invention to provide a thermoplastic squeeze tube having a one-way dispensing valve which has an integral frangible closure member to protect the valve from inadvertent discharge during shipping and storage, which provides for clean dispensing of the tube contents with a clean cut-off of product and a controlled dispensing of the product.

SUMMARY OF THE INVENTION

A thermoplastic squeeze tube with a self-sealing dispensing orifice has a hollow tubular body with a collapsible side wall, the tubular body sealable at one end and having a neck portion at the other end with a passageway through the neck portion that communicates with the hollow of the tubular body. A one-way valve member is secured in the passageway of the neck portion, which has an exposed section extending outwardly from the neck portion, which one-way valve member has a dispensing orifice, such as a slit, for tube contents. A frangible closure member is provided which is unitary with the neck portion of the tubular body and encloses and protects the exposed section of the one-way valve member.

Preferably, the frangible closure member has a bottom wall with a pocket formed therein, the walls of which closely enclose at least the upper portion of the exposed section of the one-way valve member, and which may contact the same to provide a seal thereof.

In a most preferred embodiment of the thermoplastic squeeze tube, a replacement cup-shaped closure member is provided in combination therewith which has an end wall and downwardly depending skirt, with engagement means on the neck portion of the hollow tubular body and on the downwardly depending skirt which engage to secure the replacement cup-shaped closure on the neck portion of the tube after removal of the frangible closure member therefrom. The end wall of the replacement cup-shaped closure member may have downwardly depending sealing protrusions which contain the upper portion of the exposed section of the one-way valve to seal a slit therein.

BRIEF DESCRIPTION OF THE DRAWINGS

The present invention will become more readily apparent from the following description when read in conjunction with the accompanying drawings which illustrate preferred embodiments thereof, and wherein.

DESCRIPTION OF THE PREFERRED EMBODIMENTS

Figure 1:
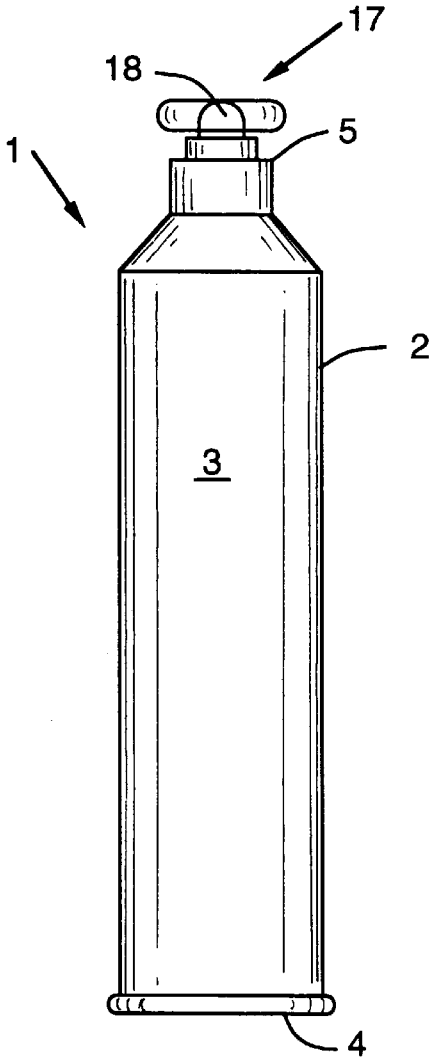
FIG. 1 is a side elevational view of the thermoplastic squeeze tube having a self-sealing orifice of the present invention.

Referring now to the drawings, the thermoplastic squeeze tube having a self-sealing dispensing orifice is shown at 1, the squeeze tube 1 having a hollow tubular body 2 with a collapsible side wall 3 which, after filling with the contents of the tube, is sealed at one end 4. A neck portion 5 is provided at the other end of the hollow tubular body 2, which neck portion has an inner end wall 6 with a passageway 7 therethrough, the passageway 7 communicating with the hollow 8 of the tubular body 2. A one-way valve member 9 is secured within the passageway 7. As illustrated, the one-way valve preferably has a flange portion 10 which seats against inner end wall 6 of the neck portion 5, and an extension 11 which extends through the passageway 7 and has an exposed portion 12 with a slit 13 therethrough, the exposed portion 12 extending outwardly from the passageway 7 of inner end wall 6. The slit 13 provides for a one-way dispensing orifice for contents of the tube when the collapsible side wall 3 is squeezed. The one-way valve member 9 may be frictionally secured against the end wall 6 of the tubular body, with the flange portion 10 frictionally engaging the inner wall 14 of the neck portion 5, by a stake or nub 15, or alternatively a weld, which may be provided on the inner wall 14 of the neck portion 5 which engages the bottom 16 of the flange portion 10 of the one-way valve member 9 to secure the same in position in the neck portion 5 and prevent dislodging of the one-way valve member 9 from the neck portion 5 of the hollow tubular body 2. A plurality of stakes 15 or nubs, such as three or five of the same, are preferably provided equidistantly about the inner wall 14 and retain the one-way valve member 9 in the neck portion 5. The formation of the stakes 15 can be controlled so as to limit the axial pressure on the flange portion 10 of the one-way valve member 9 to prevent unwanted deformation of the one-way valve member 9 and possible leakage of contents of the squeeze tube 1. Also, the fitment of the one-way valve member 9 into the passageway 7 is controlled so that an interference fit is effected without excessive deformation of the one-way valve member 9 which could cause leakage, while too loose of a fit could allow product from the tube to leak between the one-way valve member 9 and the inner wall 14 of the neck portion 5. The tightness of the fit preferred can be determined based upon the outer diameter of the one-way valve member 9, the inner diameter of the neck portion 5, the material from which the one-way valve member is formed, and the characteristics of the tube contents.

Figure 2:
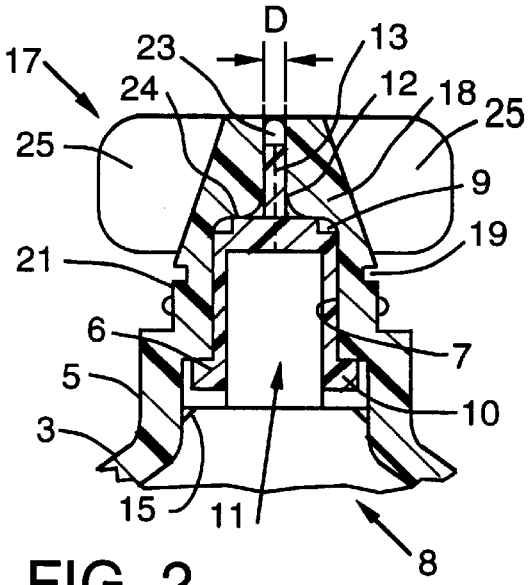
FIG. 2 is a vertical cross-sectional view including the neck portion and frangible closure member of the thermoplastic squeeze tube of FIG. 1.
Figure 3:
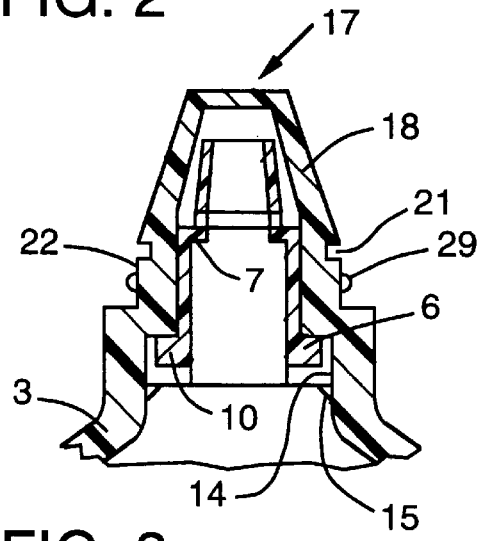
FIG. 3 is a view similar to FIG. 2 with the squeeze tube rotated 90°.

In order to seal the thermoplastic squeeze tube 1, so as to prevent unwanted discharge through the one-way valve 9 during shipping or storage, but enable easy access to the contents, a frangible closure member 17 is provided. Referring to FIGS. 2 and 3, the frangible closure member 17 comprises an extension 18 formed on an outer end wall 19 of the neck portion 5. At the connection of the extension 18 and the outer end wall 19 of the neck portion 5 there is a weakened section 20, formed such as by forming a groove or recess 21 in the outer surface 22. The frangible closure member preferably has a pocket 23 formed in a bottom wall 24 the side walls of which are spaced apart a distance d and closely enclose the exposed portion 12 of the extension 11 of one-way valve 9. By closely enclosing the exposed portion 12 and preferably being contiguous therewith, without any pressure exerted on the top end of the exposed portion 12, the side walls of the pocket retain the slit 13 in closed position and prevent unwanted discharge of tube contents through the one-way valve 9. In order to provide easy separation of the frangible closure member 17 from the neck portion 5 of the hollow tubular body 2, a pair of outwardly extending gripping members 25, such as ears, are provided on the frangible closure member 17 which preferably extend oppositely radially outwardly from the frangible closure member 17.

Figure 4:
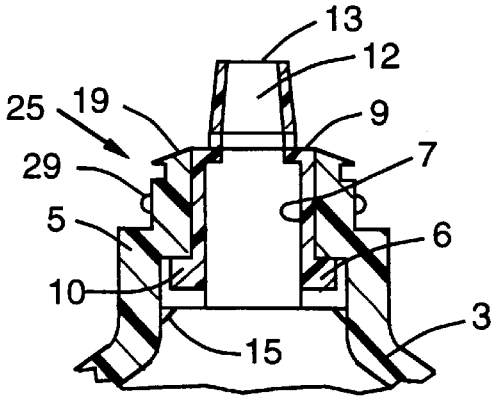
FIG. 4 is a view similar to that of FIG. 3 with the frangible closure member removed from the neck portion of the tubular body and with the one-way valve member exposed for use in discharging the contents of the squeeze tube.

In order to remove the frangible closure member 17 from the neck portion 5, the user merely grasps the ears 25 and gives a twisting motion, which will shear the weakened section 20 and break off the frangible closure member 17 to expose the exposed portion 12 of the one-way valve member 9 (FIG. 4). With the frangible closure member 17 removed, the user merely squeezes the collapsible side wall 3 of the hollow tubular body 2 which will discharge tube contents through the slit 13 of the exposed portion 12 of the one-way valve 9, while upon release of the pressure on the side wall 3, the one-way valve 9 will close the slit 13 and prevent air from being drawn back into the hollow 8 of the hollow tubular body 2.

Figure 5:
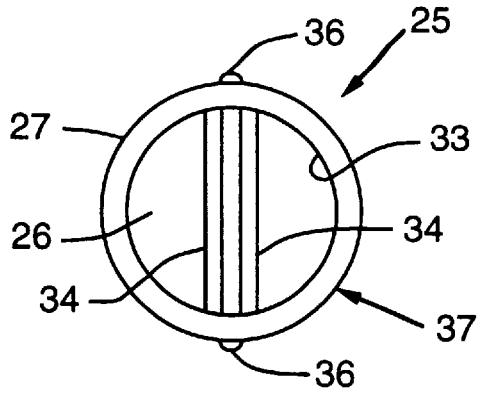
FIG. 5 is a bottom plan view of a replacement cup-shaped closure member used in combination with the thermoplastic squeeze tube of FIG. 1 after removal of the frangible closure member.
Figure 6:
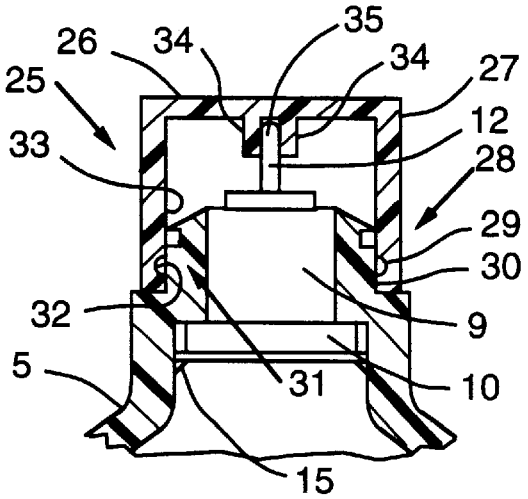
FIG. 6 is a partial cross-sectional view including the neck portion of the thermoplastic squeeze tube of FIG. 1, showing the one-way valve member in, full, after removal of the frangible closure member and with the replacement cup-shaped closure member secured thereto.
Figure 7:
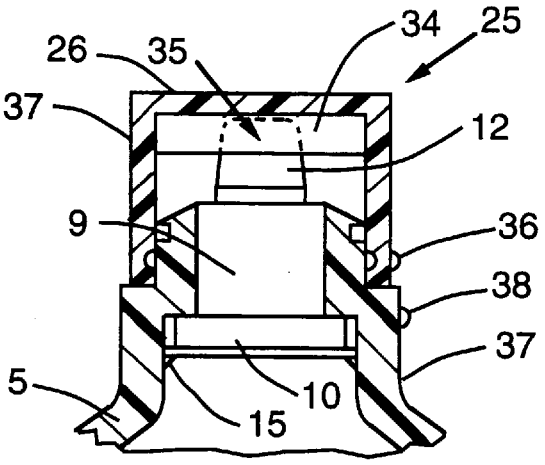
FIG. 7 is a view similar to FIG. 6 with the squeeze tube rotated 90°.

In order to be able to reseal the thermoplastic squeeze tube 1 after the frangible closure member 17 has been removed therefrom, a replacement cup-shaped closure member 25 is provided, as shown in FIGS. 5–7. The cup-shaped closure member 25 has an end wall 26 and a downwardly depending skirt 27 about the periphery of the end wall 26. To secure the replacement cup-shaped member 25 on the hollow tubular body 2, a first engagement means 28, such as an outwardly extending rib 29, is provided on the outer surface 30 of the neck portion 5 of the hollow tubular body 2, while a conforming second engagement means 31, such as a groove 32, is provided in the inner surface 33 of the downwardly depending skirt 27 of the replacement cup-shaped closure member 25. In order to assure that the one-way valve member will be securely sealed, a pair of spaced sealing protrusions 34 depend downwardly from the end wall 26 of the replacement cup-shaped closure member 25 which, when the closure member 25 is secured to the neck portion 5 of the hollow tubular body 2 will contain the upper portion 35 of the exposed portion 12 of the one-way valve member 9 and seal the slit 13 to prevent accidental discharge of the tube contents should the collapsible side wall 3 be inadvertently squeezed. To assist in correct alignment and placement of the replacement cup-shaped closure member 25 on the neck portion 5 of the hollow tubular body 2, with the exposed portion 12 of the one-way valve member 9 between the pair of downwardly depending protrusions 34, at least one indicia 36, such as an arrow or nub, may be formed on the outer surface 37 of the downwardly depending skirt 27 of the replacement cup-shaped closure member 25 which is alignable with at least one such indicia 38 formed on the lower outer surface 39 of the neck portion 5 of the hollow tubular body 2. Or, such alignment may be effected by using an oval shaped neck portion 5 and cooperating oval shaped downwardly depending skirt 27 on the replacement cup-shaped closure member 25.

The thermoplastic squeeze tubes of the present invention may be formed by various thermoplastic molding techniques but the hollow tubular bodies are preferably formed from a longitudinally stretched, extruded, thermoplastic cylinder which is cut to length and a head or neck portion formed on one end of the tube. Examples of formation of the neck portion or head on a tubular body are described, for example, in U.S. Pat. No. 3,047,910 to Downs and in U.S. Pat. No. 5,069,856 to Holoubek and Rhoades, the contents of both patents incorporated by reference herein.

The thermoplastic squeeze tube of the present invention may be formed from various thermoplastic materials such as high density polyethylene, low density polyethylene, polypropylene, polyvinyl chloride or the like, with low density polyethylene preferred, and will generally have a collapsible side wall of a thickness of about 0.010 to 0.050 inch, preferably about 0.012 to 0.020 inch.

The thermoplastic material used can be adapted to suit various products and end uses, and can enhance or affect the performance of the squeeze tube. Extremely soft/flexible materials provide excellent functional results. For example, in laboratory tests of tubes containing a hand lotion, an ultra-low density polyethylene (ASTM density of 0.905 or below) as a tube material, with a Vernay® duckbill one-way valve, provided excellent dispensing performance with about 100 percent collapse of the hollow tubular body 2 effected and a resultant negligible product residue in the spent tube; a low density polyethylene (ASTM density of 0.910 to 0.925) as a tube material gave similar results; a medium density polyethylene (ASTM density of 0.930 to 0.940) as a tube material provided excellent dispensing performance with about 90 percent collapse of the hollow tubular body 2 effected and only a resultant slight product residue in the spent tube; and a high density polyethylene (ASTM density of 0.941 to 0.959) as a tube material gave results similar to those of a medium density polyethylene.

The hollow tubular body would first be formed and a one-way valve member secured in the neck portion thereof either by a friction fit or by use of projections such as stakes, formed on the inner wall or by thermal welding. After securement of the one-way valve member and with the tubular body sealed at the neck portion end by the frangible closure member, the tube is filled with the desired contents and the other end sealed as is conventionally done, such as by a heat seal. With the one-way valve member exposed portion 12 contained in the pocket 23 by the side walls, no leakage of tube contents will occur during sealing of the other end 4 of the squeeze tube 1.

Especially useful one-way valve members that may be used in the present tube are Vernay® duckbill check valves sold by Vernay Laboratories Inc. of Yellow Springs, Ohio, U.S.A. These one-piece elastomeric valves provide one-way flow therethrough with reliable backflow prevention. A particularly useful such Vernay® duckbill check valve is one formed of a silicone rubber having a Shore A hardness of 15–90, due to the excellent oxidation and water resistance of such a material. The use of such one-piece elastomeric valves enables the tailoring of a particular elastomeric material for use with a particular product to be stored in and dispensed from the thermoplastic squeeze tube. The use of such duckbill check valves also enables clean dispensing of pharmaceutical applications for skin contact with good hygienic procedures.

The frangible closure member will assure protection of the tube contents from the atmosphere and prevent inadvertent discharge of tube contents from the hollow tubular body during storage and shipment.

In use, the user removes the frangible closure member from the neck portion of the tube. Squeezing of the collapsible side wall of the hollow tubular body will discharge tube contents from the squeeze tube through the one-way valve member. Upon release of pressure on the collapsible side wall, the one-way valve member will close and prevent entry of air into the hollow tubular body and the collapsible side wall will retain collapsed portion. If desired, the user may then place the replacement cup-shaped closure member over the one-way valve member to assure sealing of the same until future discharge of tube contents is desired.

What is claimed is:

1. A thermoplastic squeeze tube having a self-sealing dispensing orifice, comprising:

a hollow tubular body having a collapsible side wall, said tubular body sealable at one end;

a neck portion at the other end of said tubular body having an end wall with a passageway therethrough communicating with the hollow of said tubular body;

a one-way valve member secured within the passageway of the neck portion having an exposed section extending outwardly from the passageway of said end wall, with a slit therein providing a dispensing orifice for contents of said tube upon squeezing of the collapsible wall; and a frangible closure member enclosing the exposed section of said one-way valve member said frangible closure member having a bottom wall with a pocket formed therein, said Pocket closely enclosing and contacting at least the upper portion of the exposed section of said one-way valve member to seal said slit.

2. The thermoplastic squeeze tube having a self-sealing dispensing orifice as defined in claim 1 wherein said frangible member comprises an extension formed on the neck portion of the hollow tubular body, and a weakened section at the connection of said extension and said neck portion.

3. The thermoplastic squeeze tube having a self-sealing dispensing orifice as defined in claim 2 including a pair of outwardly extending gripping members extending oppositely radially outwardly from said frangible closure member.

4. The thermoplastic squeeze tube having a self-sealing dispensing orifice as defined in claim 2 wherein said weakened section comprises a groove formed in the outer wall of the neck portion of said hollow tubular member.

5. The thermoplastic squeeze tube having a self-sealing dispensing orifice as defined in claim 1 including means formed on an inner wall of said neck portion to secure said one-way valve member in the passageway of said neck portion.

6. The thermoplastic squeeze tube having a self-sealing dispensing orifice as defined in claim 1 including, in combination with the thermoplastic squeeze tube; a replacement cup-shaped closure member having an end wall and downwardly depending skirt.

7. The thermoplastic squeeze tube having a self-sealing dispensing orifice as defined in claim 6 wherein the neck portion of said hollow tubular body has a first engagement means thereon and the downwardly depending skirt of said replacement cup-shaped closure member has a second engagement means thereon engageable with said first engagement means to secure said replacement cup-shaped closure member to said neck portion after removal of said frangible closure member therefrom.

8. The thermoplastic squeeze tube having a self-sealing dispensing orifice as defined in claim 7 including a pair of downwardly depending sealing protrusions on the end wall of said replacement cup-shaped closure member which, when said replacement cup-shaped closure member is secured to the neck portion of said hollow tubular body, contain the upper portion of the exposed section of said one-way valve to seal a slit therein.

9. The thermoplastic squeeze tube having a self-sealing dispensing orifice as defined in claim 1 wherein said hollow tubular body is a material selected from the group consisting of an ultra-low density polyethylene, a low density polyethylene, a medium density polyethylene, and a high density polyethylene.

10. A thermoplastic resealable squeeze tube having a self-sealing dispensing orifice, comprising, in combination:

a hollow tubular body having a collapsible side wall, said tubular body sealed at one end;

a neck portion at the other end of said tubular body having a first engagement means thereon, and an end wall with a passageway therethrough communicating with the hollow of said tubular body;

a one-way valve secured within the passageway of the neck portion having an exposed section extending outwardly from said end wall, with a slit therein, providing a dispensing orifice for contents of the tube upon squeezing of the collapsible side wall;

a frangible closure member enclosing the exposed end of the one-way valve said frangible closure member having a bottom wall with a pocket formed therein, said pocket closely enclosing and contacting at least the upper section of the exposed section of said one-way valve member to seal said slit; and a replacement cup-shaped closure member having an end wall and a downwardly depending skirt, the downwardly depending skirt having a second engagement means engageable with said first engagement means of said neck portion to secure said replacement cup-shaped closure member on said hollow tubular body after removal of said frangible closure member therefrom.

11. The thermoplastic resealable squeeze tube having a self-sealing dispensing orifice as defined in claim 10 wherein said frangible member comprises an extension formed on the neck portion of the hollow tubular body, and a weakened section at the connection of said extension and said neck portion.

12. The thermoplastic resealable squeeze tube having a self-sealing dispensing orifice as defined in claim 11 including a pair of outwardly extending gripping members extending oppositely radially outwardly from said frangible closure member.

13. The thermoplastic resealable squeeze tube having a self-sealing dispensing orifice as defined in claim 11 wherein said weakened section comprises a groove formed in the outer wall of the neck portion of said hollow tubular member.

14. The thermoplastic resealable squeeze tube having a self-sealing dispensing orifice as defined in claim 10 including means formed on an inner wall of said neck portion to secure said one-way valve member in the passageway of said neck portion.

15. The thermoplastic resealable squeeze tube having a self-sealing dispensing orifice as defined in claim 10 including a pair of downwardly depending sealing protrusions on the end wall of said replacement cup-shaped sealing closure member which, when said replacement cup-shaped closure member is secured to the neck portion of said hollow tubular body, contain the upper portion of the exposed section of said one-way valve to seal a slit therein.

16. The thermoplastic resealable squeeze tube having a self-sealing dispensing orifice as defined in claim 15 including indicia on said hollow tubular body neck portion and on said cup-shape closure member for alignment of said sealing protrusions with upper portion of the exposed section of said one-way valve.

* * * * *